US010704252B2

(12) United States Patent
Marshall et al.

(10) Patent No.: US 10,704,252 B2
(45) Date of Patent: Jul. 7, 2020

(54) METHOD FOR LIFTING AND SUPPORTING A NEW SLAB FOUNDATION WITH HYDRAULIC JACKS

(71) Applicants: Frederick S. Marshall, Arlington, TX (US); Benjamin S. Marshall, Arlington, TX (US)

(72) Inventors: Frederick S. Marshall, Arlington, TX (US); Benjamin S. Marshall, Arlington, TX (US)

(73) Assignees: Frederick S. Marshall, Arlington, TX (US); Benjamin S. Marshall, Arlington, TX (US)

( * ) Notice: Subject to any disclaimer, the term of this patent is extended or adjusted under 35 U.S.C. 154(b) by 0 days.

(21) Appl. No.: 15/883,155

(22) Filed: Jan. 30, 2018

(65) Prior Publication Data

US 2019/0169834 A1 Jun. 6, 2019

Related U.S. Application Data

(60) Provisional application No. 62/541,531, filed on Aug. 4, 2017, provisional application No. 62/455,103, filed on Feb. 6, 2017.

(51) Int. Cl.

| | |
|---|---|
| ***E04B 1/35*** | (2006.01) |
| ***E02D 27/12*** | (2006.01) |
| ***E02D 27/02*** | (2006.01) |

(52) U.S. Cl.

CPC ..... *E04B 1/3511* (2013.01); *E02D 27/02* (2013.01); *E02D 27/12* (2013.01); *E04B 2001/3588* (2013.01)

(58) Field of Classification Search

CPC ..... E04B 1/3511; E04B 2001/3588; E02D 27/12; E02D 27/02

See application file for complete search history.

(56) References Cited

U.S. PATENT DOCUMENTS

| | | | | |
|---|---|---|---|---|
| 4,011,705 | A * | 3/1977 | Vanderklaauw | E04B 1/166 52/745.08 |
| 4,695,203 | A | 9/1987 | Gregory | |
| 5,006,015 | A | 4/1991 | Stephens et al. | |
| 6,503,024 | B2 | 1/2003 | Rupiper | |
| 6,539,685 | B2 | 4/2003 | Bell et al. | |
| 6,814,524 | B1 | 11/2004 | Peterson | |
| 7,090,435 | B2 | 8/2006 | Mitchell | |
| 7,165,915 | B2 | 1/2007 | Queen | |

(Continued)

*Primary Examiner* — Basil S Katcheves
*Assistant Examiner* — Omar F Hijaz
(74) *Attorney, Agent, or Firm* — Bracewell LLP; James E. Bradley

(57) ABSTRACT

A method for lifting and supporting above ground a concrete slab foundation employing hydraulic jacks includes installing piers in the ground, each with a pier extension protruding above ground. A lifting assembly is placed over each pier extension, the lifting assembly having a lift sleeve and upward extending lifting members. Then the slab foundation is poured, bonding a portion of the lifting assembly in concrete. After the slab foundation hardens, a jack is positioned on top of the pier extension, and lifting arms of the jack engage the lifting members. The jack is actuated to exert an upward force on the lifting assembly to lift the slab foundation above the ground. Then, the lift sleeve is rigidly secured to the pier extension, allowing the jack and lifting arms to be removed.

11 Claims, 6 Drawing Sheets

(56) References Cited

U.S. PATENT DOCUMENTS

| | | | | |
|---|---|---|---|---|
| 7,744,316 | B2 | 6/2010 | Kaufman | |
| 7,823,341 | B2 | 11/2010 | Kelly et al. | |
| 7,967,531 | B2 | 6/2011 | Collina et al. | |
| 8,118,519 | B2 * | 2/2012 | Happel | F16B 13/124 405/135 |
| 8,407,898 | B2 | 4/2013 | Marshall | |
| 8,458,984 | B2 * | 6/2013 | Marshall | E02D 27/32 405/229 |
| 8,540,461 | B2 | 9/2013 | Ong | |
| 8,887,451 | B2 | 11/2014 | Gregory et al. | |
| 8,888,413 | B2 | 11/2014 | Seider et al. | |
| 2008/0170912 | A1 * | 7/2008 | Kaufman | E02D 35/00 405/232 |
| 2008/0175673 | A1 * | 7/2008 | Roberts | E02D 35/00 405/230 |
| 2011/0020068 | A1 | 1/2011 | Kelly et al. | |
| 2011/0052329 | A1 | 3/2011 | Marshall | |

* cited by examiner

METHOD FOR LIFTING AND SUPPORTING A NEW SLAB FOUNDATION WITH HYDRAULIC JACKS

CROSS REFERENCE TO RELATED APPLICATIONS

This application claims priority to provisional application 62/541,531 filed Aug. 4, 2017 and provisional application 62/455,103, filed Feb. 6, 2017.

FIELD OF INVENTION

The present disclosure relates to a mechanism that lifts and supports above ground a newly poured slab foundation.

BACKGROUND

Many structures have been built on foundations or slabs made of concrete poured on top of soil. Constant changes in the weather and moisture levels in the soil frequently cause damage to such a foundation. In many instances, the foundation may buckle or even crack. This phenomenon occurs for a variety of reasons, including uneven changes in the water content of supporting soils, uneven compacting of soils, and uneven loads being placed on soils. Over time, uneven movement in the soils under a foundation can cause a foundation to bend or crack.

Techniques exist that allow a foundation to be poured on top of soil and subsequently raised to a desired height to eliminate potential problems caused by soil movement and/or problematic soils. Some of the techniques involve screw jacks and others employ hydraulic jacks.

SUMMARY

A method for lifting and supporting a concrete slab foundation above ground comprises installing a pier in the ground with a pier extension protruding above the ground. A lifting assembly is placed over the pier extension, the lifting assembly having a lift sleeve and a plurality of upward extending lifting members. The operator pours the slab foundation, bonding a portion of the lifting assembly in concrete. After the slab foundation hardens, a jack is positioned on an upper end of the pier extension, and lifting arms of the jack engage the lifting members. The operator actuates the jack to exert an upward force on the lifting assembly to lift the slab foundation above the ground. Then, the lift sleeve is rigidly secured to the pier extension and the jack and lifting arms removed.

The method may also include placing a seal between a lower end of the lift sleeve and the pier extension prior to pouring the slab foundation. In the embodiments shown, pouring the slab foundation bonds the concrete of the slab foundation to the lift sleeve. The lifting assembly may further comprises a base plate extending outward from a lower end of the lift sleeve, the base plate being movable with the lift sleeve. Pouring the slab foundation bonds the concrete of the slab foundation to the base plate.

The lift sleeve may be welded to the pier extension after the slab foundation has been lifted. In one embodiment, prior to pouring the slab foundation, barrier material is placed around an upper portion of the lift sleeve. Technicians remove the barrier material after the slab foundation has hardened, defining a barrier cavity in the slab foundation around the upper portion of the lift sleeve, the barrier cavity providing access to an upper rim of the lift sleeve. The barrier cavity facilitates welding the upper rim of the lift sleeve to the pier extension.

In other embodiments, the lifting assembly further comprises upward extending bolts. Technicians may secure the lift sleeve to the pier extension by welding. After removing the jack, technicians place an upper holding plate on the upper end of the pier extension, the upper holding plate having bolt holes that receive the bolts. Technicians secure the bolts to the upper holding plate with nuts.

Alternately, the upper holding plate may be placed on the upper end of the pier extension before pouring the slab foundation. If so, the jack is positioned on top of the upper holding plate. Technicians align the bolt holes with the bolts to pass the bolts through the bolt holes as the slab foundation is lifted. Nuts are secured to the bolts after insertion through the bolt holes in the upper holding plate.

The bolts may be welded to the exterior of the lift sleeve. The lifting members may comprise hooks welded to the exterior of the lift sleeve and circumferentially spaced from the bolts. The upper holding plate may have recesses that allow the hooks to pass through as the slab foundation is lifted.

In one embodiment, the pier extension comprises a solid shaft that is rectangular in transverse cross-section. The method further comprises placing a reinforcing sleeve over the solid shaft prior to installing the lifting assembly, the reinforcing sleeve having a cylindrical inner wall. The method includes sliding the lift sleeve over the reinforcing sleeve. Then after rigidly securing the lift sleeve to the pier extension, technicians disperse grout between the cylindrical inner wall of the reinforcing sleeve and the exterior of the solid shaft.

Figure 1:
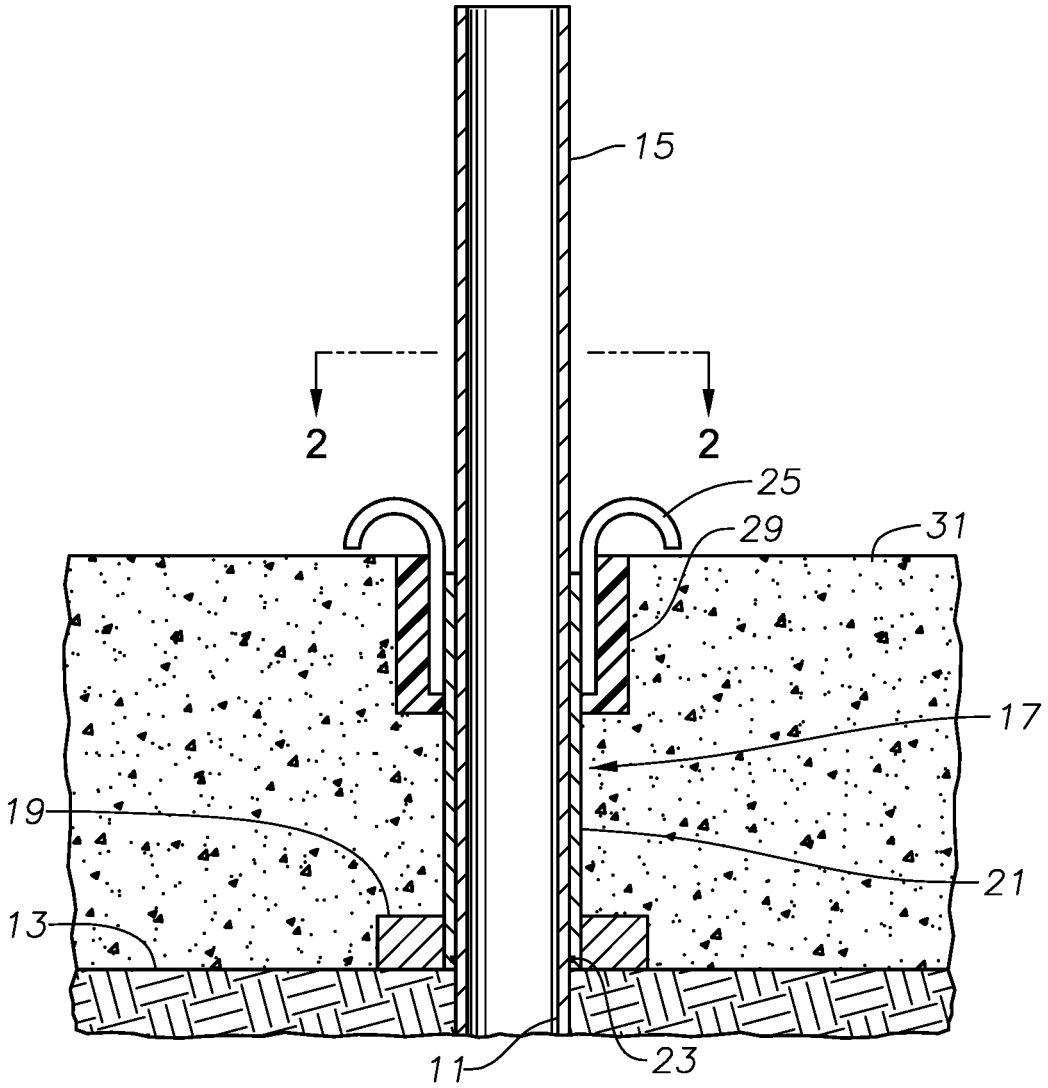
FIG. 1 is a sectional view of a lifting assembly that couples to a cylindrical pier extension pipe of a driven pier in accordance with this disclosure, and showing a slab foundation poured but not yet lifted.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates a pier 11 that has been installed in ground 13. Pier 11 has a pier extension 15 that protrudes above ground 13. In the example of FIGS. 1-4, pier extension 15 is a steel, cylindrical, hollow pipe extending upward from cylindrical concrete segments (not shown) driven into the ground.

A lifting assembly 17 is placed over the upper portion of pier extension 15. Lifting assembly 17 has a steel base plate 19 that may have a rectangular, circular, or other configuration of a perimeter. Lifting assembly 17 also has a lift sleeve 21 extending upward from a central hole in base plate 19. Lift sleeve 21 may also be formed of steel. Lift sleeve 21 is rigidly secured to base plate 19, such as by welding. In this example, lift sleeve 21 has a cylindrical interior that conforms to the cylindrical exterior of pier extension 15. A small annular clearance exists between the exterior sides of pier extension 15 and the interior side of lift sleeve 21 to enable lift sleeve 21 to slide axially relative to pier extension 15. Lift sleeve 21 has a length shorter than the distance pier extension 15 protrudes above ground 13 by an amount approximately equal to the distance that lifting assembly 17 is to be lifted. An elastomeric gasket or lower seal 23 in base plate 19 seals the annular space between the interior of lift sleeve 21 and the exterior of pier extension 15. Optionally, an elastomeric gasket or seal (not shown) may seal between the upper end of lift sleeve 21 and the exterior of pier extension 15.

In this example, lifting rods or members 25 have shanks that are attached vertically to the exterior of lift sleeve 21, such as by welding. Alternately, lifting members 25 could be attached to base plate 19. Each lifting member 25 has an upper end that protrudes above the upper end of lift sleeve 21 and has a configuration for engagement by a device to lift lifting assembly 17. In this example, the upper end is in the shape of a hook, but it could have other shapes, such as a circular eyelet. In this embodiment, two lifting members 25 are welded to lift sleeve 21, spaced 180 degrees apart from each other. More could be used and spaced circumferentially around lift sleeve 21.

Figure 2:
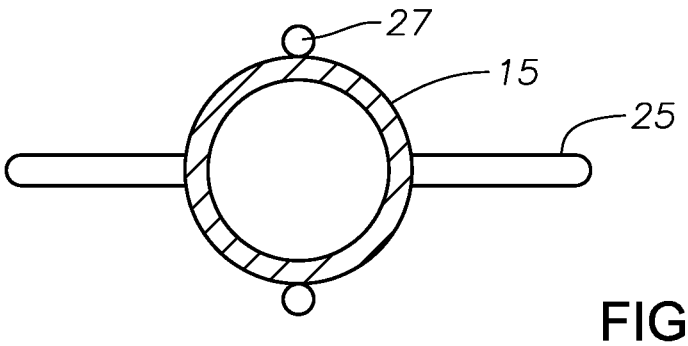
FIG. 2 is a transverse sectional view of the lifting assembly of FIG. 1, taken along the line 2-2 of FIG. 1.

Referring to FIG. 2, bolts 27 are also welded vertically to the exterior of lift sleeve 21. Each bolt 27 has a threaded upper end that protrudes above the upper end of lift sleeve 21. Bolts 27 are spaced circumferentially between lifting members 25. If two bolts 27 are employed as shown, they will be 180 degrees apart from each other and 90 degrees from lifting members 25.

During initial assembly, a barrier plug 29 will be placed around portions of lifting assembly 17. Barrier plug 29 extends around at least part of the shanks of lifting members 25 and bolts 27. The lower end of barrier plug 29 terminates well above base plate 19 to leave a substantial portion of lift sleeve 21 exposed. In the example shown, the lower end of barrier plug 29 is below the lower ends of lifting members 25 and bolts 27, but it could be higher. Barrier plug 29 is of a material that is resistant to bonding with concrete, such as a thermoplastic material.

After lifting assembly 17 has been installed on pier extension 11, a concrete slab foundation 31 will be poured. A typical slab foundation 31 will have a number of piers 11, pier extensions 15, and lifting assemblies 17 spaced a selected distance apart. The concrete of slab foundation 31 will immerse most of the exterior of lifting assembly 17, covering all but the upper end of lift sleeve 21, the upper ends of lifting members 25, the threaded upper ends of bolts 27, and portions of barrier plug 29. Seal 23 prevents concrete from flowing into the annular space between lift sleeve 21 and pier extension 15. Concrete will contact and bond to base plate 19 and to part of the exterior of lift sleeve 21. The lower side of slab foundation 31 while being poured will be in contact with ground 13 or a ground cover over ground 13. After pouring, slab foundation 31 will have an upper side that is slightly below the upper ends of lifting members 25, the upper ends of bolts 27, and the upper edge of lift sleeve 21. A typical thickness for slab foundation 31 is ten to twelve inches.

Rather than placing base plate 19 on ground 13, alternately, lifting assembly 17 could be suspended so that base plate 19 is a few inches above ground 13 before pouring slab foundation 31. The suspension could be done with wires (not shown) temporarily extending from lifting assembly 17 to the upper end of pier extension 15. This alternate arrangement would result in the lower side of base plate 19 being embedded in concrete and being above the lower side of slab foundation 31.

Figure 3:
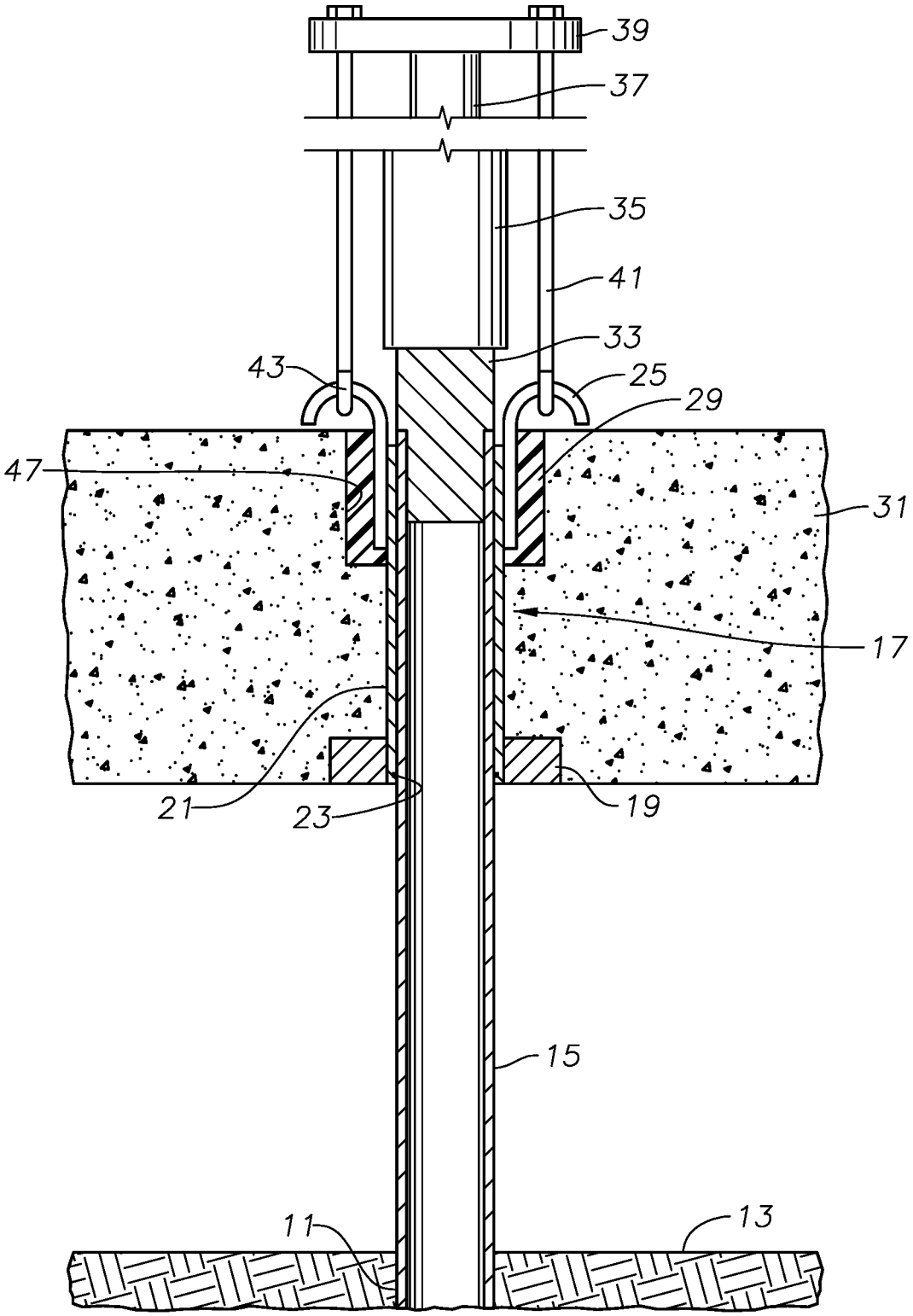
FIG. 3 is a sectional view of the of the lifting assembly of FIG. 1 after the slab foundation has been lifted.

Referring to FIG. 3, after slab foundation 31 has hardened or cured sufficiently, workers will place a hydraulic jack 35 on the upper end of pier extension 15. One technique involves inserting a lower portion of a temporary plug or adapter 33 into the upper end of pier extension 15. Adapter 33 has a downward facing shoulder that rests on the rim of pier extension 15. Jack 35 rests on adapter 33. Jack 35 could be a manually operated jack, or it could be a servo type connected by hydraulic lines to other servo type jacks on other pier extensions 15 and to a hydraulic pump (not shown). Each jack 35 has a shaft 37 that moves upward relative to the body of jack 35 when supplied with hydraulic fluid pressure. A lifting bar 39 extends laterally across the top of shaft 37. Each outer end of lifting bar 39 has a downward depending arm 41, with an engaging member 43 on its lower end for engaging one of the lifting members 25. Engaging member 43 may be a hook. Each lifting arm 41 could be a rod or a cable. Lifting arms 41 do not need to engage bolts 27.

Workers then apply hydraulic fluid pressure to the various jacks 35, which exerts an upward force on each set of lifting members 25 and each base plate 19. The upward force causes lift sleeve 21 to move upward relative to pier extension 15, along with lifting members 25, base plate 19 and slab foundation 31. The workers cease applying hydraulic fluid pressure to jacks 35 once the upper end of lift sleeve 21 is slightly below the upper edge of pier extension 15. The lower side of slab foundation 31 will now be at a selected distance above ground 13.

Figure 4:
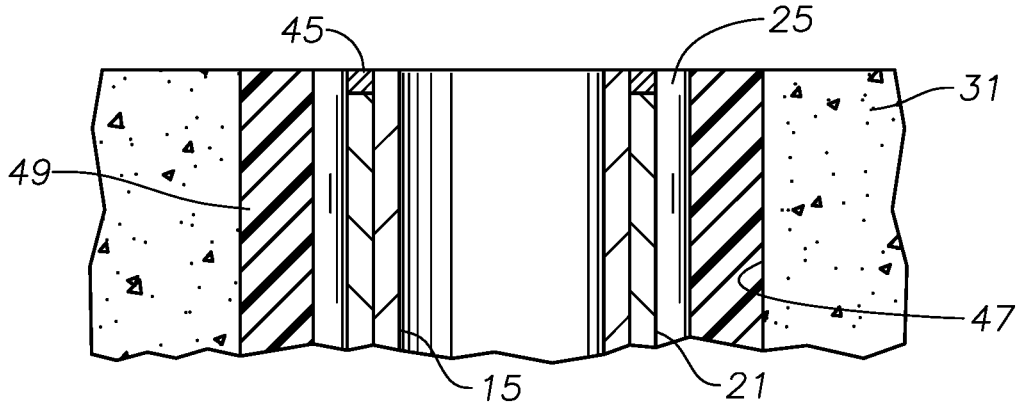
FIG. 4 is sectional view of part of the lifting assembly of FIG. 3, with the hydraulic jack removed and a lift sleeve of the lifting assembly welded to the pier extension.

Referring to FIG. 4, the workers may then remove barrier plug 29, which leaves a barrier cavity 47 in slab foundation 31. Then, workers will rigidly connect the upper end of lift sleeve 11 to pier extension 15 near the upper end of pier extension 15, such as by creating a weld 45 in this example. The workers then remove jack 35, lifting bar 39 and lifting arms 41. Because of weld 45 between the upper end of lift sleeve 21 and the upper end of pier extension 15, lift sleeve 21 will now bear a portion of the weight of slab foundation 31 and will transfer that weight to pier extension 15. Workers may then cut or grind off the hooks on the upper ends of lifting members 25 and possibly pier extension 15 to create a smooth flush surface for the upper side of slab foundation 31. The workers fill barrier cavity 47 with a filler material 49, such as grout.

Figure 5:
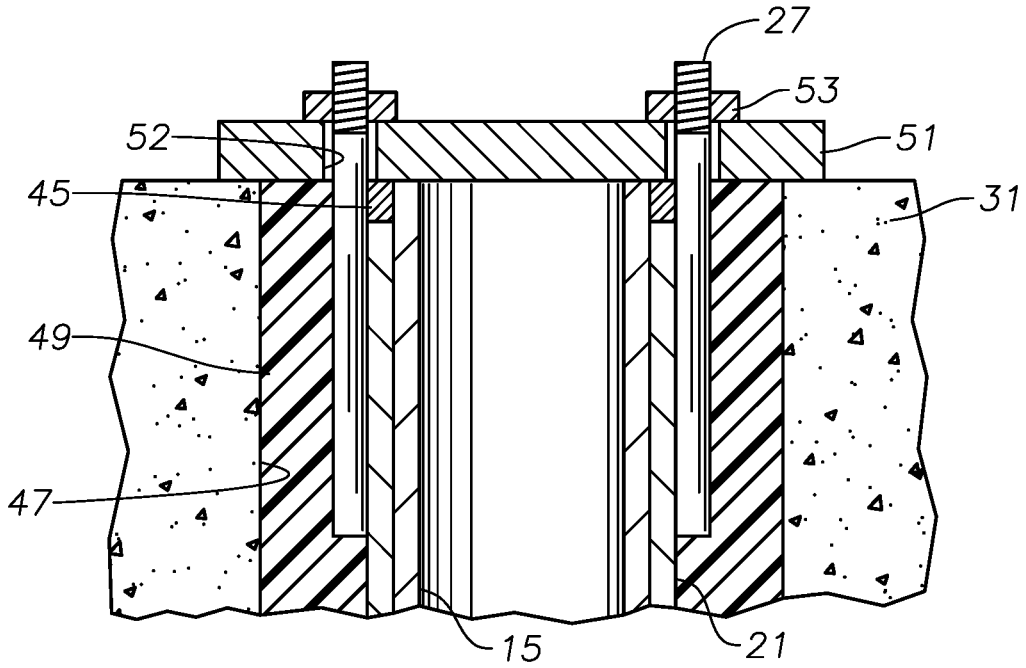
FIG. 5 is a sectional view of the lifting assembly of FIG. 4, showing an upper holding plate installed after the welding step.

Then, as shown in FIG. 5, workers will install an upper holding plate 51 on top of pier extension 15, filler material 49 and slab foundation 31. Upper holding plate 51 is a rigid load supporting member, formed of a material such as steel. Upper holding plate 51 has holes 52 that slide over the protruding threaded ends of bolts 27. Nuts 53 will be secured to the threaded ends to provide a downward preload force from upper holding plate 51 to the upper end of pier extension 15. Upper holding plate 51 provides a back up to support part of the weight of slab foundation 31 in the event of failure of weld 45 over time.

Figure 6:
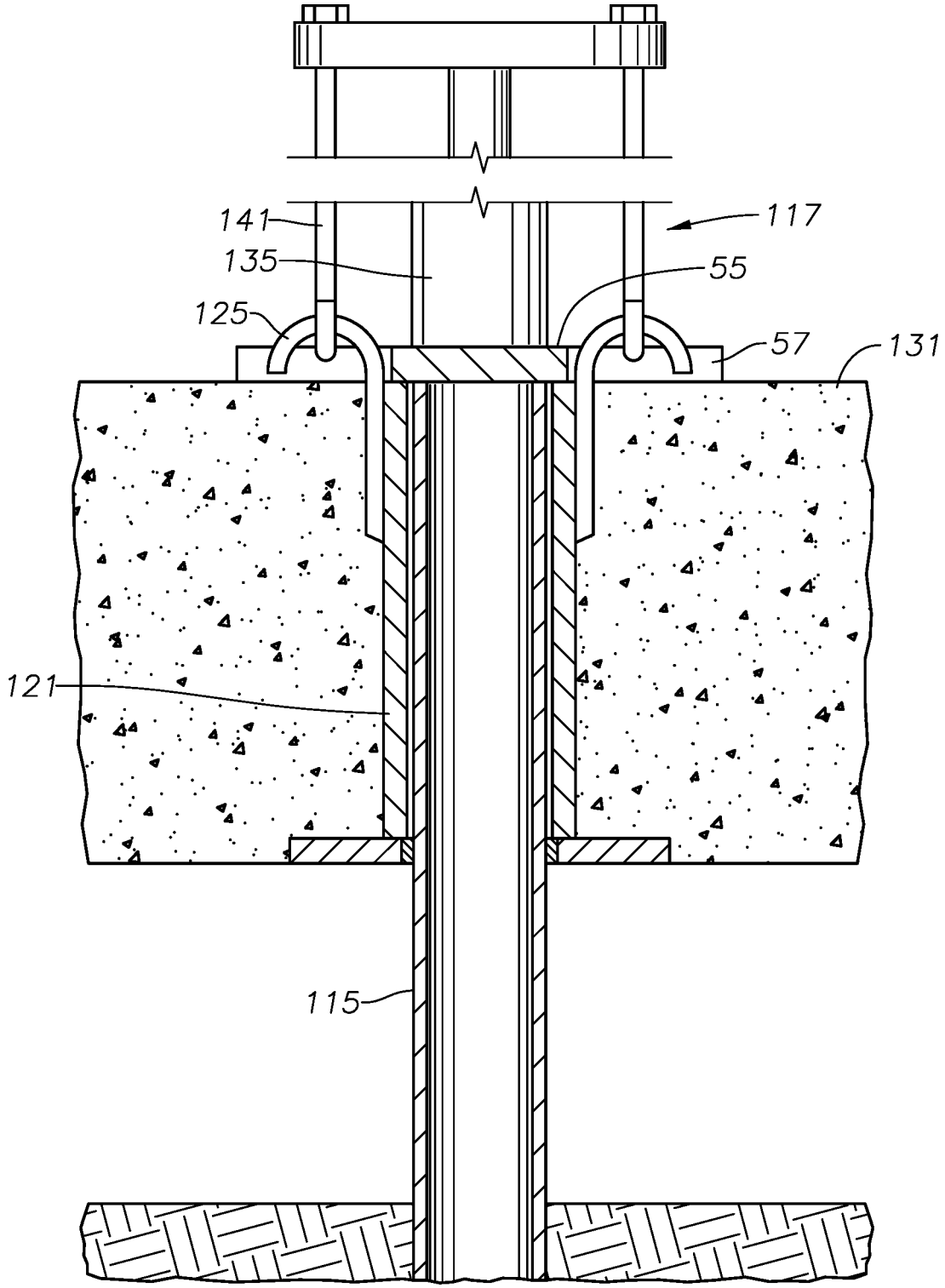
FIG. 6 is a sectional view illustrating a second method of lifting the slab foundation, wherein the hydraulic jack is supported on the upper holding plate while lifting.
Figure 7:
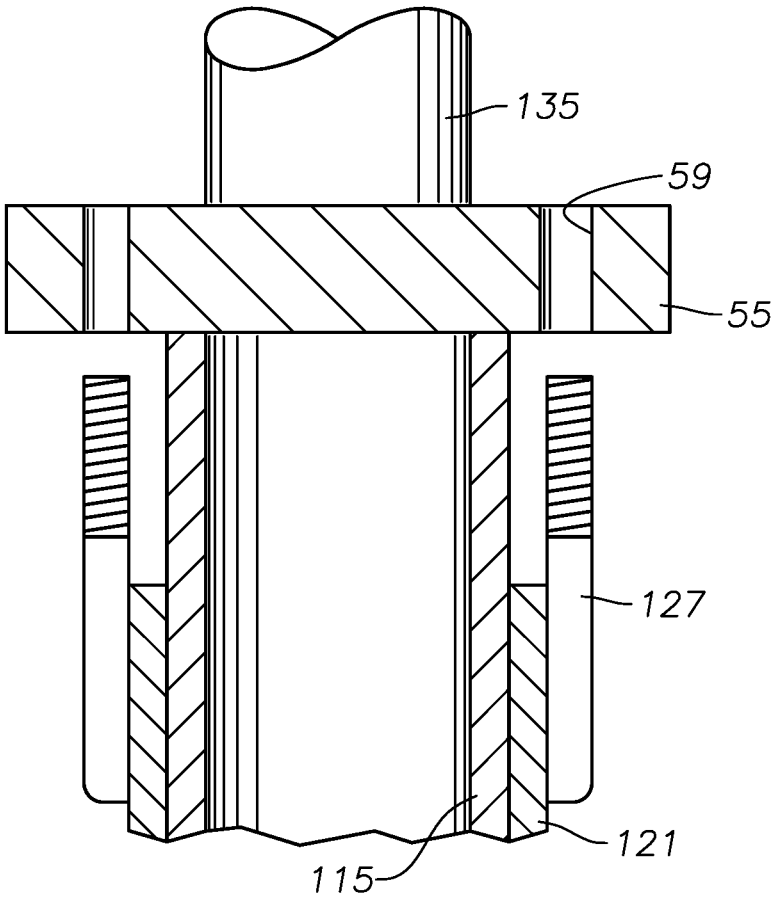
FIG. 7 is a sectional view illustrating the bolts of the lifting assembly aligned to pass through holes in the upper holding plate as the hydraulic jack is lifting the slab foundation in according with the method of FIG. 6.

Referring to FIGS. 6 and 7, components that are the same as in the first embodiment will either not be discussed again or will use the same reference numeral, but with the prefix "1". In this embodiment, lift sleeve 121 will not be welded to pier extension 115 while in the upper position, unlike the first embodiment. Instead an upper holding plate 55 will be placed on top of pier extension 115 before lifting assembly 117 lifts slab foundation 131. Upper holding plate 55 differs from upper holding plate 51 (FIG. 5) in that it has recesses 57 formed on opposite side edges to allow the vertical passage of lifting members 125. A barrier plug such as barrier plug 29 (FIG. 1) may not be required. FIG. 6 shows lifting assembly 117 and slab foundation 131 in the upper position.

Hydraulic jack 135 will be placed on upper holding plate 55 while slab foundation 131 is still in the lower position. Lifting arms 141 engage the upper ends of lifting members 125. Referring to FIG. 7, upper holding plate 55 has bolt holes 59 vertically aligned with threaded bolts 127. Bolt holes 59 are circumferentially spaced apart from recesses 57 (FIG. 6). If two recesses 57 are employed and two bolt holes 59, recesses 57 will be 90 degrees from each bolt hole 59. As jack 135 raises lift sleeve 121, the threaded upper ends of bolts 127 pass through bolt holes 59. FIG. 7 illustrates lifting assembly 117 near its upper position. Once at the desired upper position, nuts (not shown) are secured to bolts 127 to hold lift sleeve 121 and slab foundation 131 in the upper position. The upper ends of lifting members 125 may then be cut or ground off flush with the upper side of upper holding plate 55.

Figure 8:
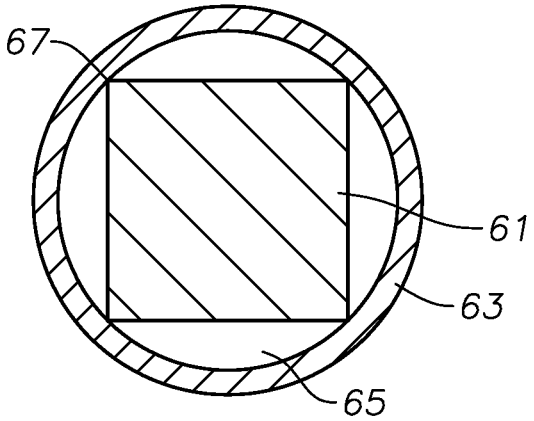
FIG. 8 is a transverse sectional view of a pier extension that is a solid, rectangular shaft that is enclosed by a reinforcing sleeve in accordance with a third method.

Referring to FIG. 8, another type of commonly used pier extension comprises a solid, steel shaft 61 that is rectangular in transverse cross section. Typically, a helical flight (not shown) will be welded to lower portions of shaft 61. The pier is formed by rotating an upper portion of shaft 61, causing the helical flight to auger into the earth. This procedure often results in permanent twists of shaft 61 on its length. The flat sides of shaft 61 thus form helical spiral surfaces along the length of shaft 61.

If shaft 61 is used, workers will slide a reinforcing sleeve 63 over shaft 61 after the helical flight is embedded to the desired depth. Reinforcing sleeve 63 is a cylindrical pipe that may be formed of steel. Reinforcing sleeve 63 will extend the full length that shaft 61 protrudes above ground. Preferably, corners 67 formed by the twisted side edges of shaft 61 are spaced closely to the inner diameter of reinforcing sleeve 63. Reinforcing sleeve 63 defines void spaces 65 between the twisted sides of shaft 61 and the inner diameter of reinforcing sleeve 63.

Figure 9:
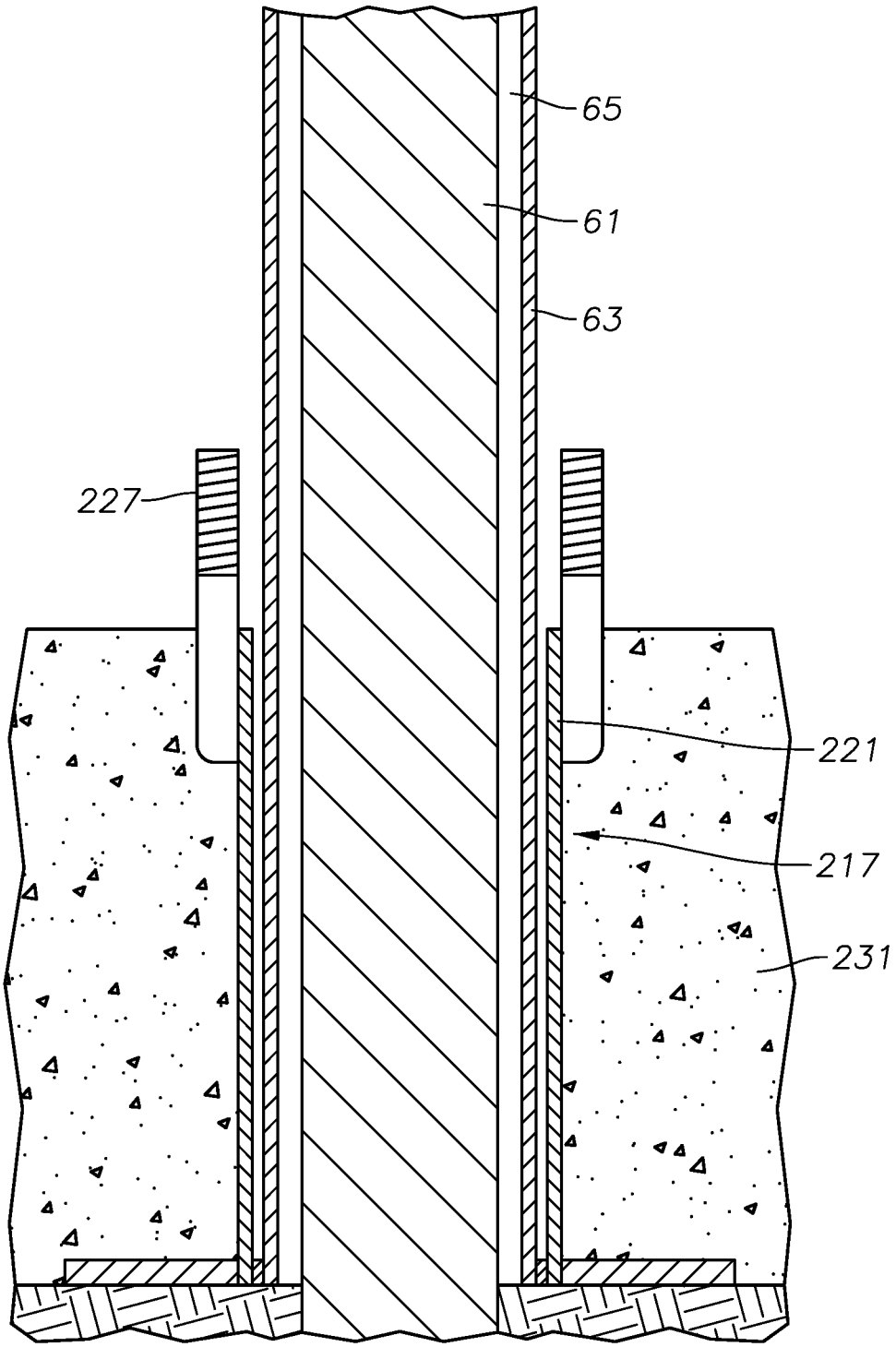
FIG. 9 is a sectional view of the pier extension of FIG. 8 and the lifting assembly after the slab foundation has been poured but prior to lifting.

Referring to FIG. 9, workers will then position lifting assembly 217 over reinforcing sleeve 63 and pour slab foundation 231. A barrier plug such as barrier plug 29 (FIG. 1) may not be needed. FIG. 9 shows slab foundation 231 after pouring but before lifting. The same procedures to lift slab foundation 231 as in FIGS. 6 and 7 are followed. Workers will place a holding plate, such as holding plate 55 (FIG. 6), on top of shaft 61 and reinforcing sleeve 63. A hydraulic jack will be positioned on top of the holding plate. As the jack lifts lifting assembly 217 and slab foundation 231, bolts 227 will pass through bolt holes in the upper holding plate, enabling nuts to be secured to hold lifting assembly 217 and slab foundation 231 in the upper position. Reinforcing sleeve 63 does not move upward during lifting as the upper holding plate will be on top of it. Welding of reinforcing sleeve 63 to lift sleeve 221 is not needed. After removal of the jack, workers inject a filler material, such as grout, into the voids 65 (FIG. 8) between reinforcing sleeve 63 and shaft 61.

The present disclosure described herein, therefore, is well adapted to carry out the objects and attain the ends and advantages mentioned, as well as others inherent therein. While a a few embodiments have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A method for lifting and supporting a concrete slab foundation above ground, comprising:

installing a pier in the ground with a pier extension protruding above the ground;

placing a lifting assembly over the pier extension, the lifting assembly having a lift sleeve and a plurality of upward extending lifting members and a plurality of upward extending bolts;

pouring the slab foundation, bonding a portion of the lifting assembly in concrete;

positioning a jack above an upper end of the pier extension, and engaging lifting arms of the jack with the lifting members;

actuating the jack to exert an upward force on the lifting assembly to lift the slab foundation above the ground to an upper position;

placing an upper holding plate on an upper end of the pier extension, the upper holding plate having bolt holes through which the bolts pass;

securing nuts to the bolts and tightening the nuts against an upper side of the upper holding plate after the slab foundation is in the upper position; and removing the jack and the lifting arms and leaving the bolts permanently secured to the lift sleeve and the upper holding plate, such that after removal of the jack and the lifting arms, a portion of the weight of the slab foundation transfers from the lift sleeve through the bolts to the upper holding plate.

2. The method according to claim 1, further comprising:

placing a seal between a lower end of the lift sleeve and the pier extension prior to pouring the slab foundation, thereby sealing an annulus between the lift sleeve and the pier extension from the entry of concrete during pouring of the slab foundation.

3. The method according to claim 1, wherein:

placing the upper holding plate on the pier extension occurs prior to lifting the slab foundation with the jack; and positioning the jack above an upper end of the pier extension comprises placing the jack on the upper holding plate.

4. The method according to claim 1, wherein:

the bolts pass through the bolt holes as the slab foundation is lifted.

5. A method for lifting and supporting a concrete slab foundation above ground, comprising:

installing a pier in the ground with a pier extension protruding above the ground;

placing a lifting assembly over the pier extension, the lifting assembly having a lift sleeve and a plurality of upward extending lifting members;

pouring the slab foundation, bonding a portion of the lifting assembly in concrete;

positioning a jack on an upper end of the pier extension, and engaging lifting arms of the jack with the lifting members;

actuating the jack to exert an upward force on the lifting assembly to lift the slab foundation above the ground; then rigidly securing the lift sleeve to the pier extension and removing the jack and the lifting arms; wherein:

the lifting assembly further comprises upward extending bolts welded to an exterior of the lift sleeve;

the lifting members comprise hooks welded to the exterior of the lift sleeve and circumferentially spaced from the bolts;

rigidly securing the lifting assembly to the pier extension comprises:

placing an upper holding plate on the upper end of the pier extension before lifting the slab foundation, and placing the jack on top of the upper holding plate, the upper holding plate having bolt holes that receive the bolts as the slab foundation is lifted and recesses that allow the hooks to pass through the recesses as the slab foundation is lifted; and securing nuts to the bolts after insertion through the holes in the upper holding plate.

6. The method according to claim 5, wherein:

the pier extension comprises a solid shaft that is rectangular in transverse cross-section; and the method further comprises:

placing a reinforcing sleeve over the solid shaft prior to installing the lifting assembly, the reinforcing sleeve having a cylindrical inner wall; then sliding the lift sleeve over the reinforcing sleeve; then dispersing grout between the cylindrical inner wall of the reinforcing sleeve and the exterior of the solid shaft.

7. A method for lifting and supporting above ground a concrete slab foundation, comprising:

installing a pier in the ground with a pier extension protruding above the ground;

providing a lifting assembly with a lift sleeve, a plurality of upward extending lifting members, and a plurality of upward extending bolts;

pouring the slab foundation, bonding the lift sleeve in concrete, placing an upper holding plate on an upper end of the pier extension, the upper holding plate having a plurality of bolt holes and a plurality of recesses, the lifting members protruding through the recesses in the upper holding plate;

positioning a hydraulic jack on the upper holding plate, and engaging lifting arms of the jack with the lifting members;

actuating the jack to exert an upward force on the lifting assembly to lift the slab foundation above the ground to an upper position;

inserting the upper ends of the bolts through the bolt holes in the upper holding plate and while the slab foundation is in the upper position, securing nuts to the bolts and tightening the nuts against an upper side of the upper holding plate; then removing the jack and the lifting arms, leaving the bolts and the lifting arms permanently secured between the lift sleeve and the holding plate, thereby transferring a portion of the weight of the slab foundation from the lift sleeve through the bolts and the nuts to the upper holding plate.

8. The method according to claim 7, wherein:

the upper ends of the bolts pass through the bolt holes in the upper holding plate as the jack lifts the slab foundation.

9. The method according to claim 8, wherein:

the lifting members are circumferentially spaced around the lift sleeve, relative to a longitudinal axis of the lift sleeve; and the bolts are circumferentially spaced around the lift sleeve, relative to the longitudinal axis.

10. The method according to claim 7, further comprising:

placing a seal between a lower end the lift sleeve and the pier extension prior to pouring the slab foundation, thereby sealing an annulus between the lift sleeve and the pier extension from the entry of concrete during pouring of the slab foundation.

11. The method according to claim 7, wherein:

the pier extension comprises a solid shaft that is rectangular in transverse cross-section; and the method further comprises:

placing a reinforcing sleeve over the solid shaft prior to installing the lifting assembly, the reinforcing sleeve having a cylindrical inner wall;

sliding the lift sleeve over the reinforcing sleeve; and dispersing grout between the cylindrical inner wall of the reinforcing sleeve and the exterior of the solid shaft.

* * * * *